US006364258B1

(12) United States Patent
Naranjo

(10) Patent No.: US 6,364,258 B1
(45) Date of Patent: Apr. 2, 2002

(54) BALLOON SUPPORT STAND FOR DECORATIVE ARRANGEMENTS

(76) Inventor: Peter Naranjo, 72 Sierra Meadow Dr., San Jose, CA (US) 95116

( * ) Notice: Subject to any disclaimer, the term of this patent is extended or adjusted under 35 U.S.C. 154(b) by 0 days.

(21) Appl. No.: 09/561,733

(22) Filed: Apr. 27, 2000

(51) Int. Cl.[7] ..... A47F 17/00

(52) U.S. Cl. ..... 248/154; 248/176.1; 248/188; 211/14

(58) Field of Search ..... 248/127, 146, 248/154, 176.1, 188, 499; 446/220; 211/14, 13.1; 244/31, 98; D11/131; D6/396, 509; 108/153.1, 157.16, 159

(56) References Cited

U.S. PATENT DOCUMENTS 908,999 A * 1/1909 Johnson ..... 108/153.1
1,037,882 A * 9/1912 Erickson ..... 211/14
1,329,584 A * 2/1920 de Marinis ..... 244/31
1,764,226 A * 6/1930 Rennack ..... 108/157.16
1,781,506 A * 11/1930 Godefroy ..... 244/62
3,120,932 A * 2/1964 Stahmer ..... 244/24
3,901,164 A * 8/1975 Urti ..... 108/153.1
4,890,408 A * 1/1990 Heiges et al. ..... 43/3
5,026,010 A * 6/1991 Camarota ..... 248/188.1
5,297,763 A * 3/1994 Cazort ..... 244/31
5,424,137 A * 6/1995 Stagl ..... 428/542.4
5,755,419 A * 5/1998 Gearhart et al. ..... 248/346.01

* cited by examiner

*Primary Examiner*—Anita King
*Assistant Examiner*—Jon Szumny
(74) *Attorney, Agent, or Firm*—The Kline Law Firm

(57) ABSTRACT

A support stand that allows a decorative display of a balloon in combination with flowers, wine, or any object that the user chooses to include. The device includes a support structure utilized in combination with a netting and a balloon. The support structure includes an upper disk attached to a lower disk by means of four elongated rods. The upper disk includes a large central hole to receive and support the balloon. The lower disk is essentially solid, but includes a plurality of radial slots. The slots are used to receive and secure a net or other fabric used as a cover to hold the balloon in place. The rods of the support structure define an interior display space that may be used to hold flowers, a bottle of wine, or some other object intended for display with the balloon stand.

5 Claims, 4 Drawing Sheets

BALLOON SUPPORT STAND FOR DECORATIVE ARRANGEMENTS

FIELD OF THE INVENTION

The present invention relates generally to decorative devices, and more particularly is a support stand that creates a balloon display device.

BACKGROUND OF THE INVENTION

Many devices have addressed the use of balloons in decorative displays. Most of the prior art devices are directed to methods of securing helium filled balloons on display for sale.

One such device is the "Balloon Bouquet Holder" of Bartels, U.S. Pat. No. 5,938,154, issued Aug. 17, 1999. This device utilizes a generally cylindrical body to provide sufficient anchoring weight for the balloons. The body includes a plurality of vertical slots which receive strings tied to the balloons.

Another display device presumes securing means more rigid than a string. This device, the "Display Holder for Balloons, Flowers or the Like" by Pomerantz, U.S. Pat. No. 5,509,540, issued Apr. 23, 1996, includes a plurality of tubular holders in a base. The tubular holders receive a balloon secured on a stick or a flower.

Another device that utilizes similar tubular holders is the "Balloon Holder and Method for Displaying and Holding Balloons" by Page, U.S. Pat. No. 5,823,365, issued Oct. 20, 1998. This device is intended to be suspended from a ceiling, but also results in presenting a plurality of tubular holders for the balloons.

One of the shortcomings of the prior art devices is that there is typically no provision for displaying a combination of items, such as balloons and flowers, simultaneously. Moreover, the devices in the prior art tend to be fairly difficult and expensive to manufacture.

Accordingly, it is an object of the present invention to provide a means to attractively display balloons in combination with other items.

It is a further object of the present invention to provide a device that is simple and inexpensive to manufacture.

SUMMARY OF THE INVENTION

The present invention is a support stand that allows a decorative display of balloons in combination with flowers, wine, or any object that the user chooses to include.

The device includes a support structure utilized in combination with a netting and a balloon. The support structure comprises an upper disk attached to a lower disk by means of four relatively long rods. The upper disk includes a large central hole to receive and support the balloon. The lower disk is essentially solid, but includes a plurality of radial slots. The slots are used to receive and secure a net or other fabric used as a cover to hold the balloon in place. The rods of the support structure define an interior display space that may be used to hold flowers, a bottle of wine, or some other object for display with the balloon stand.

An advantage of the present invention is that it creates a very attractive decoration with the balloon and the netting. The netting can be decorated in any way that the user desires.

Another advantage of the present invention is that the support stand is very simple and inexpensive to manufacture.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
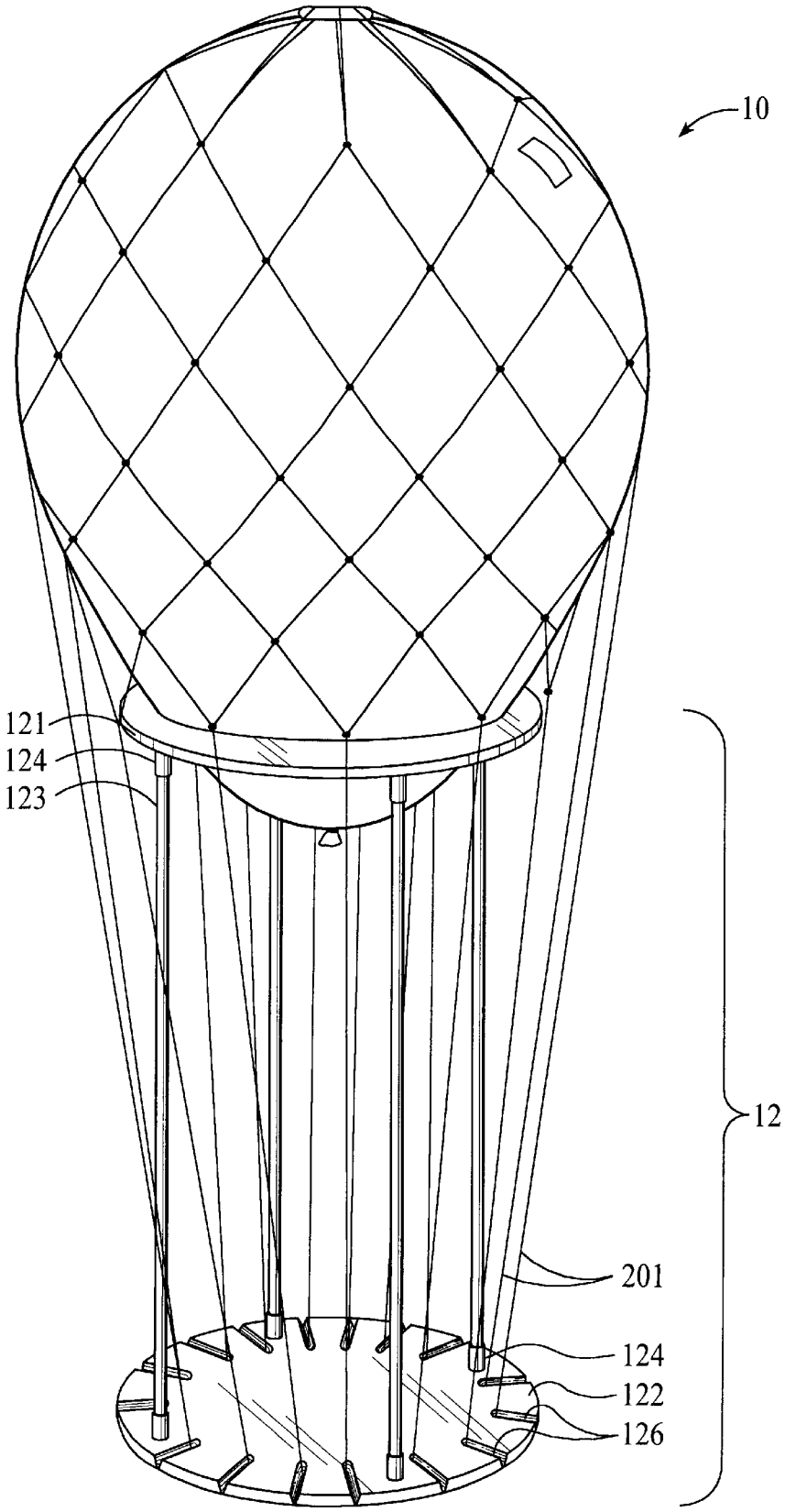
FIG. 1 is a perspective view of the balloon support stand of the present invention.
Figure 2:
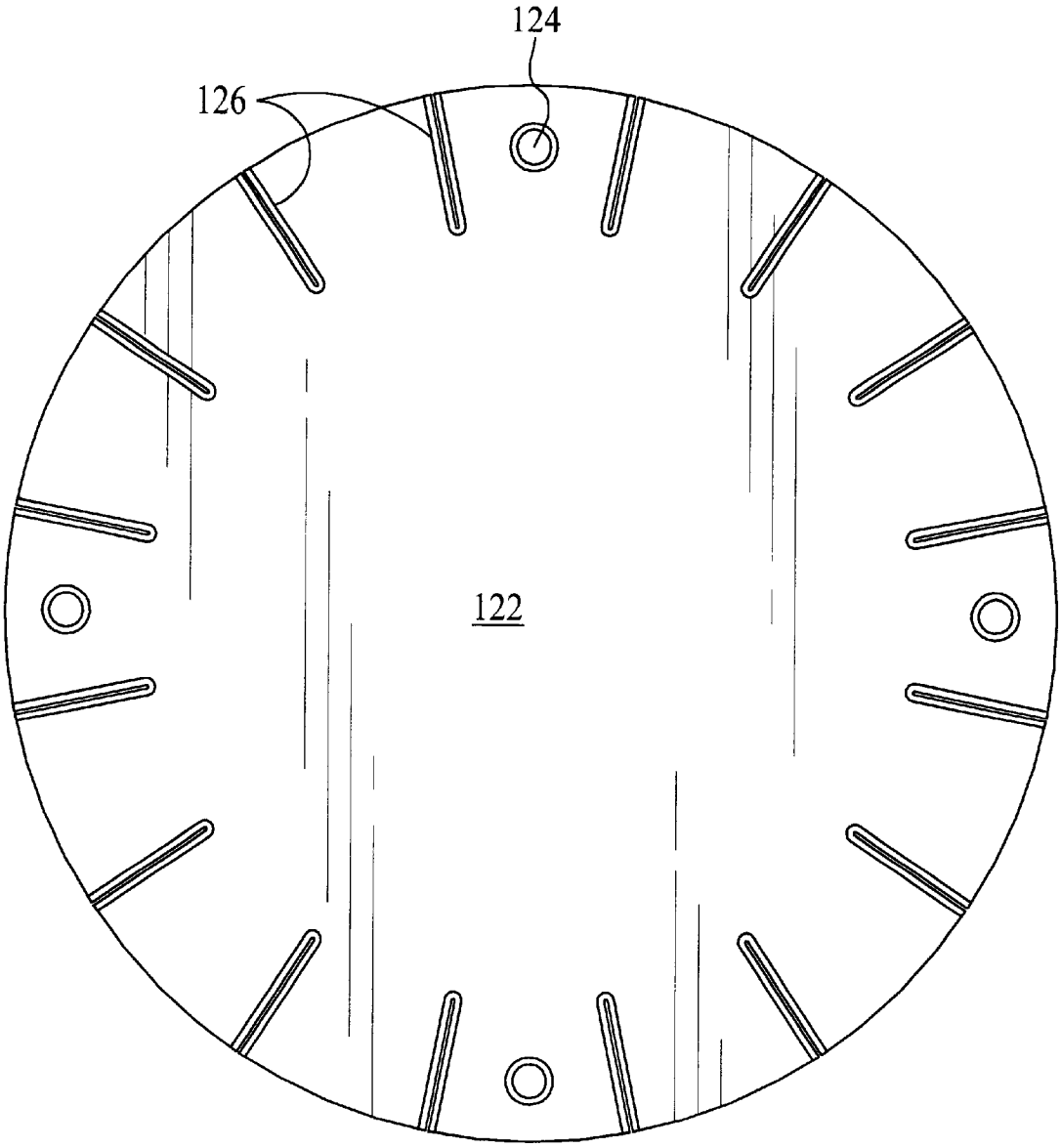
FIG. 2 is a view of the upper surface of the lower disk of the support structure.
Figure 3:
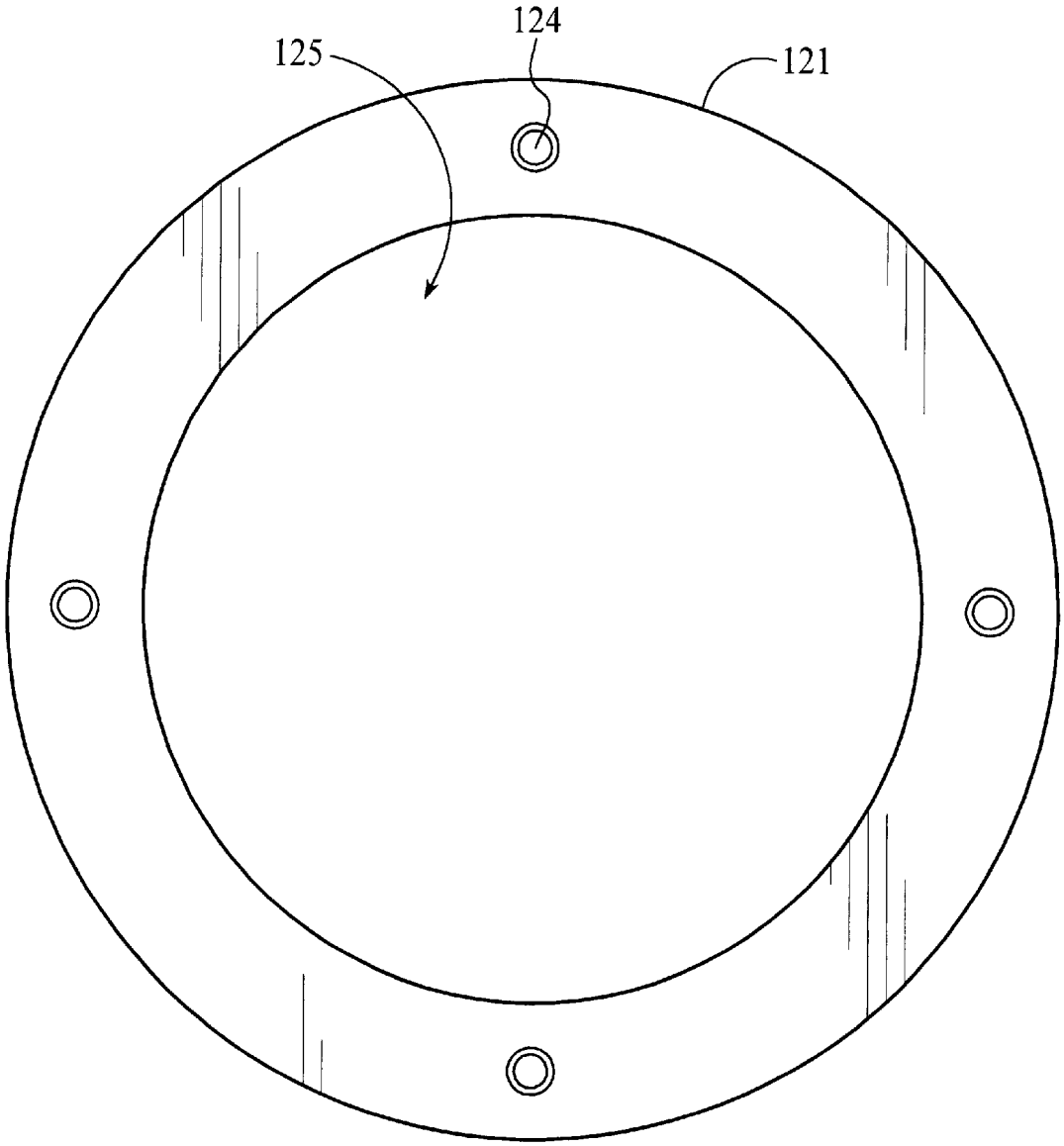
FIG. 3 is a view of the lower surface of the upper disk of the support structure.
Figure 4:
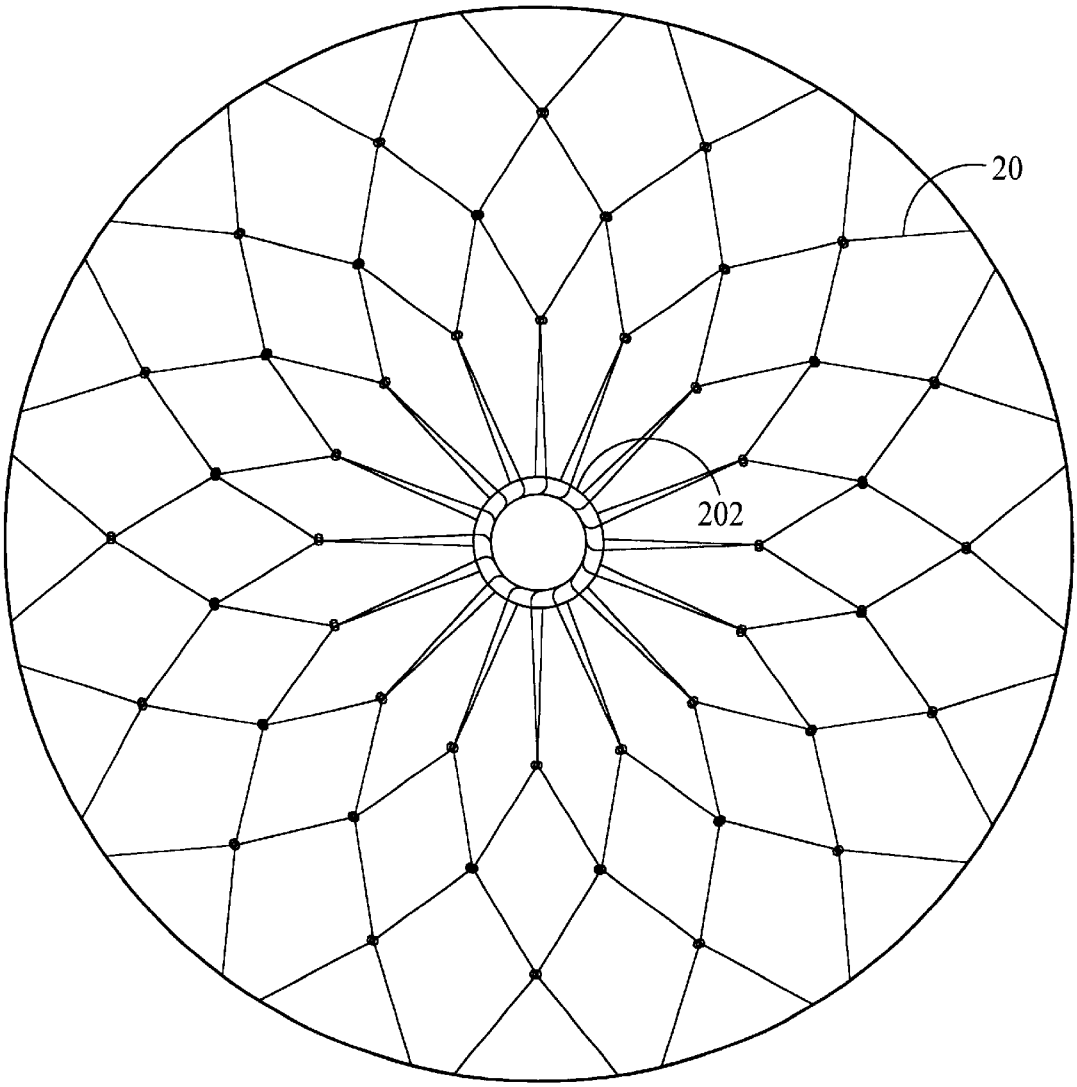
FIG. 4 is a top view of the device showing the netting covering the top of the balloon.

The present invention is a balloon support stand 10 for decorative arrangements. The device comprises a support structure 12 that defines an interior display space 14. The balloon stand 10 allows a decorative display of a balloon 16 in combination with a display object such as flowers, wine, or any other object that the user chooses to include in the display. In the preferred embodiment, the balloon 16 is an air balloon, but it is recognized that a helium balloon or any other spherical object could be used with the device.

The support structure 12 comprises an upper disk 121 attached to a lower disk base 122 by means of four elongated rods 123. The upper disk 121 and the lower disk base 122 can of course be formed in other than circular shapes, but the disks are most easily manufactured and used. The ends of the elongated rods 123 are inserted into sockets 124 that are integral to the upper disk 121 and the base 122. The rods 123, the upper disk 121, and the base 122 define an interior display space 14. The interior display space 14 is used to hold the display object, which may be flowers, a bottle of wine, or any other object that the user would like to display with the balloon stand 10.

The upper disk 121 further includes a balloon receiving means 125 that receives and supports the balloon 16. In the preferred embodiment of the present invention, the balloon receiving means 125 is simply a large central opening in the upper disk 121. The disk base 122 is essentially solid, but includes a plurality of radial slots 126. The slots 126 are used to receive and secure a fabric cover 20. In the preferred embodiment, the slots 126 are tapered from top to bottom to allow the user to more easily attach and to more effectively secure anchor means 201 of the fabric cover 20.

The fabric cover 20 covers the top of the balloon 16 and holds it in place in the balloon stand 10. The fabric cover 20 will typically be a netting, and is intended to be decorated in a variety of designs. The netting 20 is secured at a top side by a joining ring 202. The user of the device 10 can decorate the fabric cover 20 according to the theme of an event, or in any way that the user chooses. The cover 20 is placed over the top of the balloon 16, and the anchor means 201 are secured in the radial slots 126 of the base 122 to secure the cover 20 and balloon 16 in place in the balloon stand 10.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A support stand for decorative arrangements comprising:

a support structure, a spherical object, and a cover means; wherein said support structure comprises an upper support element attached to a base, said upper support element includes an open receiving means in a central portion thereof so that a closed lower portion of said spherical object passes through and is seated in and supported by said upper support element, and said base includes a plurality of radial slots open to an outer perimeter of said base, anchor means of said cover means being received and secured in said radial slots of said base; such that said cover means covers a top of said spherical object and holds said spherical object in place in said support stand.

2. The support stand as defined in claim 1 wherein:

said upper support element is attached to said base by means of elongated rods, said rods are received in sockets affixed to a lower surface of said upper support element and an upper surface of said base, said rods, said upper support element and said base defining an interior display space adapted to hold a display object.

3. The support stand as defined in claim 1 wherein:

said radial slots are tapered from top to bottom.

4. The support stand as defined in claim 1 wherein:

said spherical object is a balloon.

5. The support stand as defined in claim 1 wherein:

said cover means is formed from woven netting.

* * * * *